US007578748B2

(12) United States Patent
Evans

(10) Patent No.: US 7,578,748 B2
(45) Date of Patent: Aug. 25, 2009

(54) GOLF SWING TRAINING DEVICE AND METHOD

(76) Inventor: John Burton Evans, 5943 Buechler Bend, Columbus, OH (US) 43228

( * ) Notice: Subject to any disclaimer, the term of this patent is extended or adjusted under 35 U.S.C. 154(b) by 0 days.

(21) Appl. No.: 11/676,130

(22) Filed: Feb. 16, 2007

(65) Prior Publication Data

US 2008/0200276 A1 Aug. 21, 2008

(51) Int. Cl.
*A63B 69/36* (2006.01)

(52) U.S. Cl. ..... 473/257; 473/266

(58) Field of Classification Search ..... 473/257, 473/417, 422, 451, 219, 266, 269, 276; 482/83, 482/90

See application file for complete search history.

(56) References Cited

U.S. PATENT DOCUMENTS

| | | | | | |
|---|---|---|---|---|---|
| 925,342 | A * | 6/1909 | Johnson | 482/90 |
| 3,022,072 | A * | 2/1962 | Zinnow | 482/90 |
| 4,662,630 | A * | 5/1987 | Dignard et al. | 482/83 |
| 4,830,371 | A * | 5/1989 | Lay | 473/423 |
| 4,938,478 | A * | 7/1990 | Lay | 473/423 |
| 5,046,724 | A * | 9/1991 | Sotomayer | 482/90 |
| 5,722,920 | A * | 3/1998 | Bauer | 482/83 |
| D437,908 | S * | 2/2001 | Hsiung et al. | D21/787 |
| 6,241,640 | B1 * | 6/2001 | Chu | 482/83 |
| 6,896,630 | B1 * | 5/2005 | Breining | 473/422 |
| 7,329,210 | B1 * | 2/2008 | Marano | 482/83 |

* cited by examiner

*Primary Examiner*—Nini Legesse
(74) *Attorney, Agent, or Firm*—Dane Butzer

(57) ABSTRACT

A golf swing training system, including a paddle suitable for hitting with a palm in training to improve one's golf swing, a swing arm attached to the paddle, a base that provides stability, and a spring attached to the swing arm and to the base. Preferably, the spring is removably and/or adjustably attached to the swing arm and/or to the base. Also, methods of using the system.

16 Claims, 5 Drawing Sheets

GOLF SWING TRAINING DEVICE AND METHOD

FIELD OF INVENTION

The present invention relates generally to a golf swing training device and method.

BACKGROUND OF THE INVENTION

A consistent, controlled, smooth and effective golf swing is required to successfully play the game of golf. It is a goal of every golfer. The sport of golf is easy to describe but difficult to execute because many factors are involved in accurately swinging a golf club to strike a ball in a control led manner.

The neurobiology involved in a golf swing is equally simple to describe. The cerebellum in the base of a human brain is connected via the spinal cord to all muscles in the body. The cerebellum is responsible for the coordination of muscle movement and therefore controls motor movements of muscles in the body. This control is communicated to muscles through nerve cells.

Brain cells are composed of millions of neurons, which extend their network circuit of neuron throughout the body. Each neuron is connected to each other through its nerve fiber. Once activated, brain cell neurons send messages via electrical signals to neurons connected to relevant muscles. Executing these messages, the muscle neurons will then either cause the muscle to contract or to relax. In such a way, brain cells can control the action of muscles.

The network of neuron circuits works both ways. That is, muscles in turn also can control brain cells via neuron circuits. Neurons located in the muscles of the body are connected to the brain via nerve fibers. Any physical stimulation of the muscles causes these neurons in the muscles to generate physical stimulation signals, which are fed back to the brain cells (neurons) that are involved in generating muscle control signals. This creates or completes a servo loop of neuron circuits that controls muscle movements, from brain to muscles and from muscles to brain.

Scientists define such muscle control circuits as muscle memory. In view of foregoing, muscle memory involves the servo loop circuit comprised of both brain and body neural circuits. As with many things, the more often a muscle control circuit servo loop is activated, the stronger it becomes. For example, once an individual learns to ride a bicycle, the ability to ride the bicycle is recorded in muscle memory circuits and continues to be operative for a lifetime.

The development of muscle memories for golf swings is essential to achieve successful swings that allow a club head to accurately hit a golf ball. However, hitting the golf ball accurately is only half of the story. Strength is also often required to hit the golf ball a desired distance. Thus, most of successful golfers have both great muscle memory for successful golf swings and muscle strength tailored to the specific muscles involved in the muscle memory.

People have made many attempts to enhance muscle memory to improve a golf swing. Many of these devices and methods produce inconsistent results partly due to the complexity of golf swing motions and partly because they fail to cultivate muscle memory.

Existing golf swing training methods often overcomplicate the functions of the swing plan and preferred club positioning. Golfers often give up trying to improve their swings, commenting that their feel of swing is distracted by having to remember many technical adjustments required to correct faults in their swing. Effective muscle memory training is more likely to be effective if done independently of making such technical adjustments to a swing.

Some methods try to guide the path of a putter or a golfer's swing arm or body motion. These methods or devices are incapable of accurately allowing a golfer to experience the feeling of properly swinging their own clubs in a real golf game. In other words, restricted movements caused by these methods force a golfer to focus on technicality instead of feeling the motion of a golf swing.

Weight-training techniques, such as THERABAND™, will strengthen muscles. They do not appear to help a golfer to maintain a proper swing plan, nor do they improve the mechanics of a swing. As such, while these weight-training techniques should help a golfer to improve his or her general muscle strength, they might not help a golfer improve target muscle strength specific for an effective golf swing, and most likely will not help a golfer to gain muscle memory necessary to improve his or her golf swing.

Some attempts have been made to create weight training method specific to strengthen muscles for golf swings, such as aquatic golf swing training device or devices including a hollow ball. However, these techniques still require a person to pay attention to technical intricacies of golf swings, such as balance, twist, proper swing planes, etc. In addition, these devices also tend not to give a golfer a feel of an effective transfer of force from body to palm needed to successfully improve one's golf swing. A golfer using these methods cannot feel how an actual swing would feel. As a result, he or she cannot adjust his or her swing stance, swing pattern, and muscle strength accordingly to acquire the desired muscle memory.

Various loops, tethers, cuffs, harnesses and the like have been proposed for training golfers by physically constraining one or more body movements. These devices may be awkward to use or inconvenient to attach. Moreover, restraining certain muscle movements offers no guarantee that bad habits will not be resumed when the restraints are removed.

SUMMARY OF INVENTION

In view of the foregoing, there is a need to train groups of muscles selectively in both strength and muscle memory to improve overall golf swing performance. It also would be desirable to provide a simple and transportable swing training method or device, where the body naturally constrains itself, and a golfer can actually feel the transfer of the energy from his or her body to his or her palm without having to worry unduly about the intricacy of golf swing movements. To achieve that part, a golfer's swing movement should not be restricted in anyway, while he or she can also get a feel of the transfer of the energy from body to palm without worrying about various technical points involved in swinging a golf club. Slowly, as the golfer starts to feel the transfer of the energy from body to palm, the golfer can optimize the energy transfer from body to palm. The optimization process will help the golfer to improve every point of his or swing unconsciously through his muscle memory, to learn to control the force of his or her swing, and to strength target muscles necessary for efficient golf swings.

Embodiments of the invention address some or all of the concerns discussed above. Products according to the invention have the potential to be simple to manufacture, inexpensive, and widely accepted.

A preferred embodiment of a golf swing training system includes a paddle suitable for hitting with a palm in training to improve one's golf swing, a swing arm attached to the paddle, a base that provides stability, and a spring attached to the swing arm and to the base. Preferably, the paddle, the swing arm and the base are made of suitable materials.

One or more soft pads preferably can be attached to the hard surface of the paddle to protect a person's palm when the system is in use.

Preferably, the swing arm stands vertically when force is not applied to the paddle. A height of the swing arm preferably is adjustable. Furthermore, the swing arm preferably is removably attached to both the paddle and the spring, and if the swing arm is also attached to the base, the swing arm preferably is also removably attached to the base.

The spring preferably is adjustably and/or removably attached to the swing arm and/or to the base.

In a preferred embodiment, the base includes plural detachable parts. For example, the base could be in an "H" shape with a front part, a back part, and a middle part. In some embodiments, at least some parts of the base are hollow with one or more caps on their ends, and the caps can be removed permit filler material such as sand or water to be placed in the parts.

The base can be flat, can have a fixed height, or can have and adjustable height. In some embodiments, the base rests on the floor or ground. In other embodiments, the base is capable of being attached to a floor or the ground.

In a preferred embodiment, the system also includes a stopper to stop excess motions of the swing arm during golf swing training. The stopper preferably partially or completely encircles a junction where the swing arm is attached to the spring, and wherein the stopper is attached to the base. The stopper also preferably is removably attached to the base, although this need not be the case.

As noted above, various components of the system preferably are removable attached to each other. Thus, the system can be disassembled for transport or storage. In some embodiments of the invention, all of these components can be put into a container, and a device on or attachable to the container can attach the system to a golf-bag or a golf cart.

The invention also encompasses methods of using the above golf swing training systems.

This brief summary has been provided so that the nature of the invention may be understood quickly. A more complete understanding of the invention may be obtained by reference to the following description of the preferred embodiments thereof in connection with the attached drawings.

DETAILED DESCRIPTION OF PREFERRED EMBODIMENTS

Figure 1:
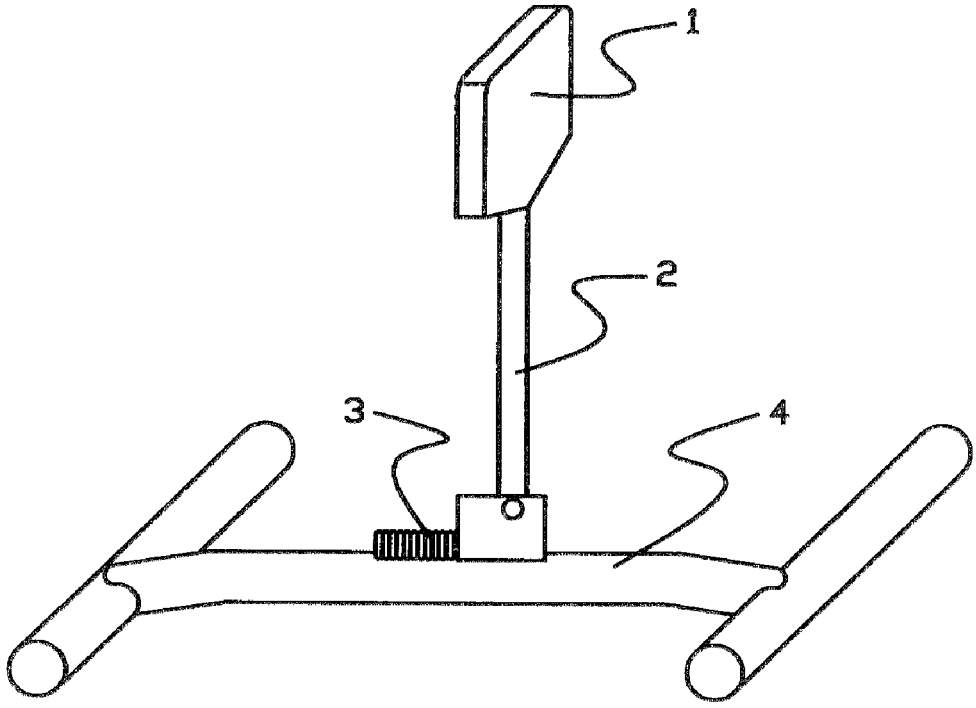
FIG. 1 shows a view of a golf swing training system.

The present invention relates a golf swing training system, the use of which should teach a golfer to improve his golf swing through a more efficient transfer of his energy from body to palm.

Lexicography

The term "suitable material," as used herein, refers to metal alloys, plastic, wood, or other suitable materials as long as it provides stability needed for a golf swing training system. A "suitable material" can be made by any of known methods for making a metal, plastic, rubber, or wood part, whether they be methods involving mixing, heating, extruding, pelleting, or rolling.

The term "removably attached," as used herein, indicates something that can be detached using no tools or using common hand tools such as a screwdriver, wrench, and the like.

The term "target," as used herein, refers a spot to which a golf ball will reach after a successfully executed golf swing.

The term "target line," as used herein, refers to a horizontal line between the target and the golf ball. To successfully execute a golf swing, a golfer should first visualize a target line from the golf ball to the target, and then swing the golf club to hit a golf ball to reach the target along the target line. The term "center line," in this case, means the centerline of a base of this invention, which imitates the initial portion of a "target line" in an actual golf swing.

The term "initial golf swing stance" refers to an initial golf swing stance that a golfer takes to give a consistent and effective golf swing according to any preferred golf swing method. A preferred embodiment of an initial golf swing stance is a process, including (1) setting up a target line or a centerline; (2) placing one's body (shoulders and feet) parallel to the line; (3) visualizing a target line; (4) finding a reference point (see below); and (5) spreading one's feet slightly apart around the golf ball (the junction between the centerline and the swing arm of the golf swing system) suitable for putting, chipping, or a full-golf swing. Other initial golf swing stances can also be used as long as they assist a golfer in giving a consistent and effective golf swing.

The term "five points," as used herein, refers to (1) the front point of the right shoulder; (2) the front point of the left shoulder; (3) the front most point of the left hip; (4) the front most point the right hip; (5) the open palm of the right hand. At the moment of the impact between the golf club and the golf ball, these five points form a "five-point plane," in which all five points should be aligned in one plane. In a preferred embodiment of a method of using a golf swing training system (see below for details), a five-point plane should be formed at the moment of the impact between one's palm and a paddle of our invention. This five-point plane should be perpendicular to a "target line" or a "center line."

The term "reference point," as used herein, refers the right side of the base of one's neck when it aligns vertically with the right side of a golf ball. The right of the golf ball is the side of the ball that faces away from the target. This "reference point" sets the initial golf swing stance after a golfer places one's body parallel to the target line. The "reference point plane" is perpendicular to the "target line." This reference point should stay in the same place throughout the swing, although one can rotate the reference point during a swing.

The term "three points," as used herein, refers to (1) the right shoulder, (2) the left shoulder, and (3) the open palm of the right hand. These three points form a "three-point plane" at the time of the impact between a golf ball and a golf club. When using a training system, these three points form a "three-point plane" at the time of the impact between a palm and the paddle. This "three-point plane" is perpendicular to the target line, and it is more suited for chipping.

The term "one point plane," as used herein, refers to one point line up that can be used for putting. This "one point" is the palm of one's right hand if one is a right-handed person.

Golf Swing Training System

A preferred embodiment for a golf swing training system includes a paddle suitable for hitting with a palm in training to improve one's golf swing, a swing arm attached to the paddle, a base that provides stability, and a spring attached to the swing arm and to the base. Preferably, the spring is removably and/or adjustably attached to the swing arm and/or to the base.

Accordingly, FIG. 1 shows a view of a golf swing training system, which includes paddle 1 for hitting with one's palm, swing arm 2 attached to paddle 1 and to spring 3, and base 4 for stability. Preferably, the spring is removably attached to the swing arm and/or to the base. The spring preferably also is adjustably attached to the swing arm and/or to the base to permit adjustment of the strength of forces exerted by one when using the system. In some embodiments, such as the one shown in FIG. 1, swing arm 2 is also attached to base 4. In other embodiments, spring 3 can be interposed between swing arm 2 and base 4, with the swing arm attached to the base through the spring. Alternatively, the spring could be placed by a side of or internal to the swing arm. Other variations are possible.

In such golf swing training systems, the paddle, the swing arm and the base are all made of suitable material, as defined above.

The types, sizes, shapes and spacing of the paddle, the swing arm, the spring, and the base shown in FIG. 1 are preferred. However, any other shapes can be used. For example, shapes including but not limited to shapes of spheres, oval solids, pyramids, cubes, rectangular solids, and double pyramids can be used, as well as other shapes.

Paddle

Figure 2:
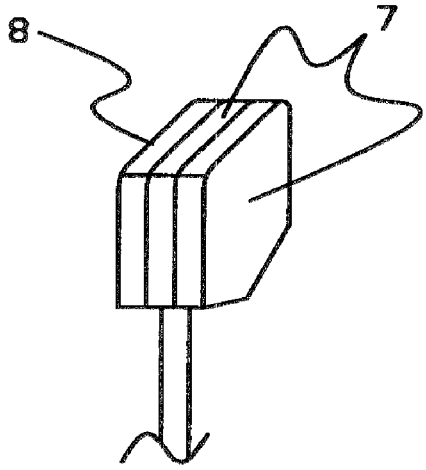
FIG. 2 shows use of pads with an embodiment of the system.

One or more soft pads preferably can be attached to the hard surface of the paddle to protect a person's palm when the system is in use. In a preferred embodiment of a golf swing training system, sometimes two or three soft pads made of different density foam can be used. Further, one or more the soft pads preferably can be removed from the paddle. The thickness of the soft pad(s) preferably can be adjusted so that a golfer can feel the transfer of energy from body to palm through the impact between palm and the paddle without injuring his palm. The soft pads can be made of, but not limited to, foam, cotton pads, or any other soft padding material. Accordingly, FIG. 2 shows that one or more soft pads 7 can be attached to paddle 8 to protect one's palm during the impact. In an alternative embodiment, the paddle is made of a material that can be struck with a palm without significant discomfort or risk of injury.

Swing Arm

Returning to FIG. 1, swing arm 2 preferably stands vertically when force is not applied to the paddle, and the height of the swing arm 2 is about the height of the knuckles of one's hand to the ground when one uses a golf club to hits a golf ball. This height preferably is adjustable for individual use. Alternatively, the height could be fixed.

In a preferred embodiment, swing arm 2 is removably attached to both paddle 1 and spring 3. If swing arm 2 is also attached to the base, swing arm 2 preferably can be detached from the base.

Spring

In use, one strikes paddle 1 with one's palm, as explained in more detail below. When paddle 1 is struck, swing arm 2 swings or moves with the force of the strike. Spring 3 provides resistance to the strike and resets swing arm 2 after the strike. The spring preferably is adjustability attached to base 26 to provide variable resistance to forces needed for different types of swings Spring 3 can be any suitable spring that returns swing arm 2 to its "at rest" position. Metal springs have been found to work well and are preferred, but other types of springs can be used. Alternatively, all or a portion of swing arm 2 could be made of a spring-like material or a material that has memory, for example a suitably strong rubber or plastic. In that case, that portion of swing arm 2 would be considered to be spring 3.

Base

The base can be flat, can have an adjustable height, or can have a fixed height. Preferably, the base has an "H" shape when viewed from above, as shown in FIG. 1. This shape has been found to be easy to construct and to provide good stability while staying out of the way of one's feet when using the system. Other shapes can be used. In some embodiments, these shapes are adjustable. In other embodiments, they are fixed.

Figure 3:
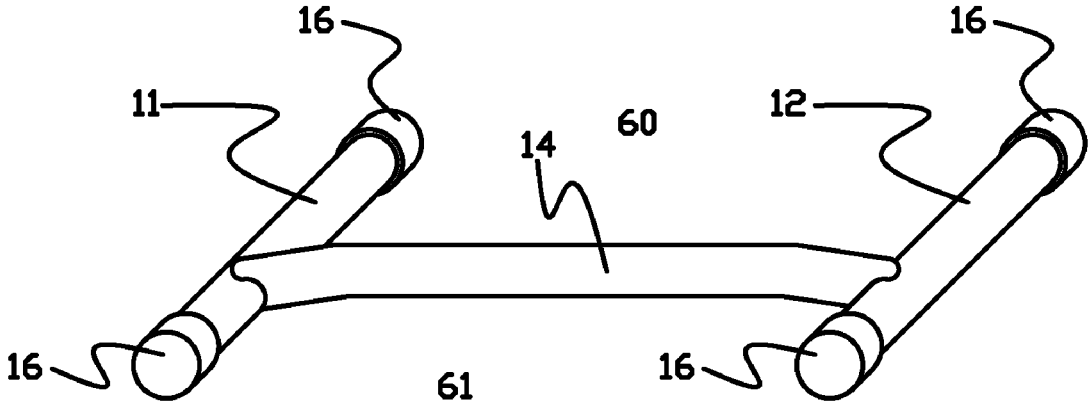
FIG. 3 shows an "H" shaped base for an embodiment of the system.

In some embodiments, the base includes several detachable parts. For example, FIG. 3 shows an "H" shaped base that includes front part 11, back part 12, and middle part 14 that are detachable. As shown, middle part 14 corresponds to the cross stroke of the H shape, and middle part 14 is in a plane in which swing arm 2 swings (also see FIG. 1) FIG. 3 (as well as FIGS. 1, 4 & 5) also show front part 11 and back part 12 extending further to side 60 of middle part 14 than side 61 of middle part 14 (i.e., the H shape is lopsided with respect to middle part 14). Alternatively, the base could have another shape, could include other detachable parts, or could be made of one single piece.

The base can be solid or can be hollow. In a preferred embodiment, at least front part 11 and back part 12 preferably are hollow, with caps 16 on the ends of the parts. The caps preferably can be removed, permitting filler material such as sand, water, or any other suitable filler material to be placed in the parts to add weight and stability to the base. Once the filler has been placed in the parts, the caps can be replaced to prevent leakage of the filler.

Figure 4:
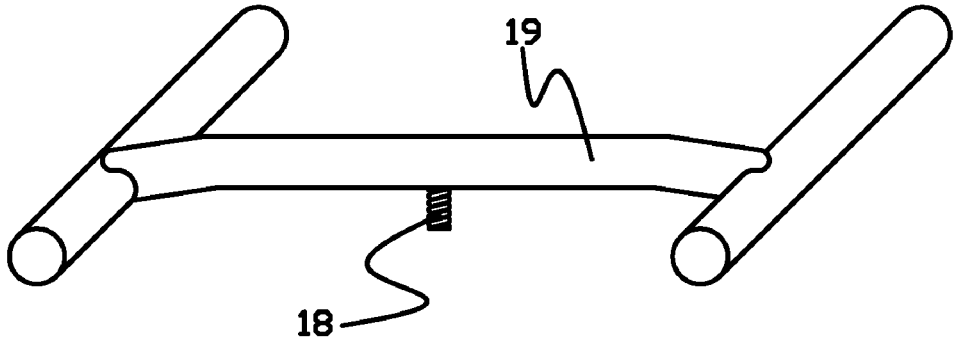
FIG. 4 shows use of a bolt to secure a base of an embodiment of the system.

In alternative embodiments, the base is attached to the floor or the ground using any conventional attachment methods such as, but not limited to, bolts, nails, or permanent glue. FIG. 4 shows such an embodiment in which bolt 18 attaches base 19 to the ground.

Stopper

Figure 5:
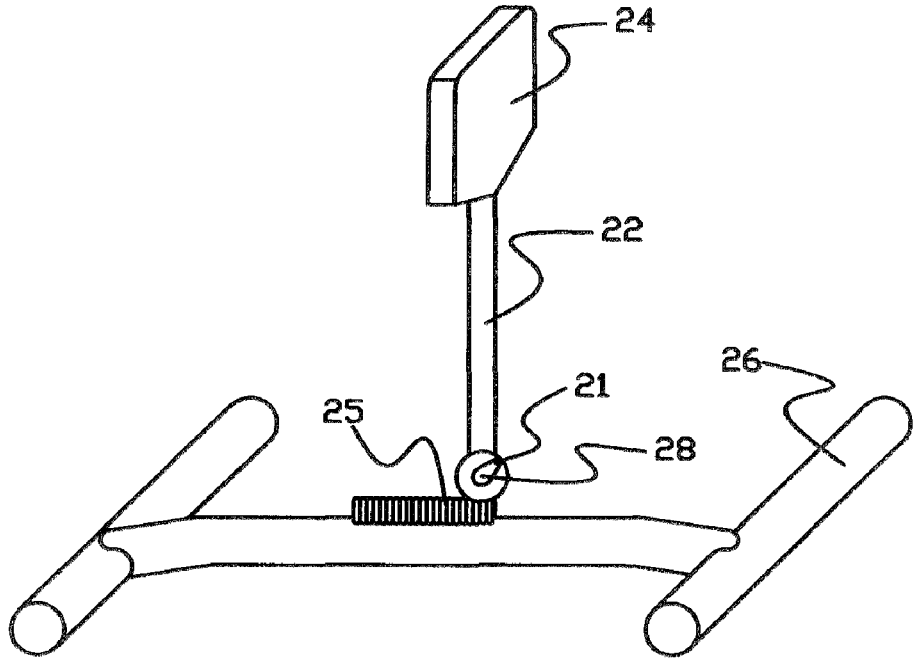
FIG. 5 also shows an arrangement of a stopper for an embodiment of the system.

As shown in FIG. 5 (with optional cover plate omitted), a further embodiment of a golf swing training system includes stopper 21 to stop excess motions of swing arm 22 during a simulated golf swing. FIG. 5 also shows that swing arm 22 in this embodiment is also attached to paddle 24 for hitting with one's palm and to spring 25. The spring preferably is adjustably attached to base 26 to provide variable resistance to forces needed for different types of swings. In a preferred embodiment, stopper 21 partially or completely encircles or is located near junction 28 where swing arm 22 is attached to spring 25. Other types of stoppers can be used.

Disassembly, Transport, and Storage

Figure 6:
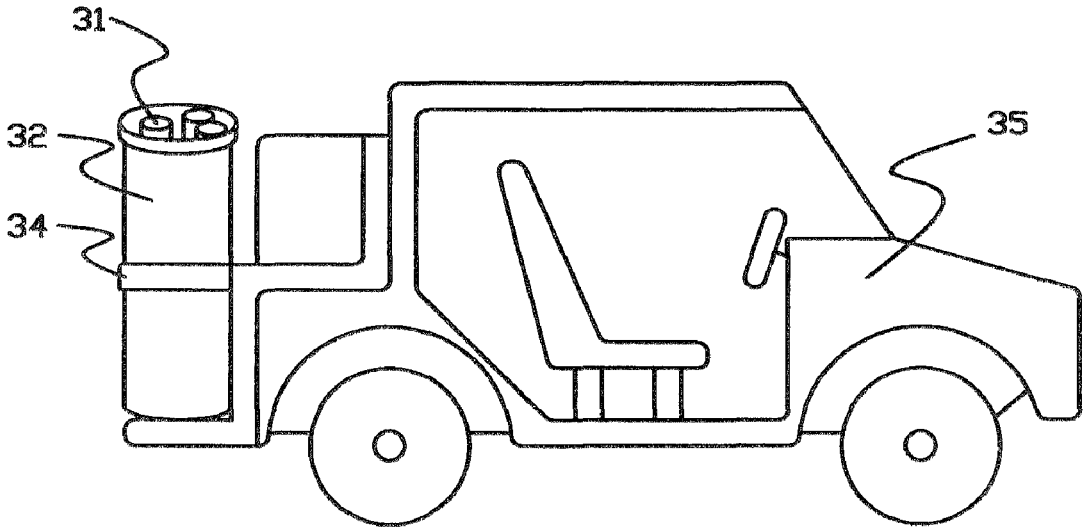
FIG. 6 shows a carrying bag that can be used with an embodiment of the system.

As noted above, some or all of the components of the golf training system preferably are removably attached to and therefore detachable from each other. As a result, some embodiments of the system can be easily disassembled for transport or storage. In such embodiments, the golf swing training system preferably includes a container that is capable of containing all components of the system. The system in these embodiments also preferably includes a device on or attachable to the container that permits the system (including the container) to attach to a golf-bag or a golf cart. Thus, FIG. 6 shows an embodiment of golf swing training system 31 that has been disassembled and placed inside carrying bag 32. Also included is device 34 that can be used to attach the carrying bag to a golf-bag or golf cart 35. Device 34 can be a string, a belt, or any other conventional attaching device. Further, device 35 can be detached from carrying bag 32.

Such a system might be of particular use to an individual golfer. In particular, a golfer might like to have a light training system to carry with them during golf outings. A system such as that shown in FIG. 6 could be set up before or after a round of golf, permitting the golfer to work on his or her swing close to their actual game. This can be an excellent time to improve a swing before a game or to correct bad habits from which a golfer suffers during a game.

Other arrangements are possible, which may or may not be capable of being easily disassembled and/or transported. For example, for a permanent commercial-sized training system, a golf swing training system with its base bolted to the ground or a floor might be desirable.

Method of Using Golf Swing Training System

An embodiment of a method of using a golf swing training system includes steps of setting up a golf swing training system with a suitable force by adjusting a spring; facing the golf swing training system; setting up an initial golf swing stance; executing a golf swing suitable for full-golf swing, chipping, or putting; and slapping a palm on a paddle of the system with a suitable force at the part of the swing.

Figure 7:
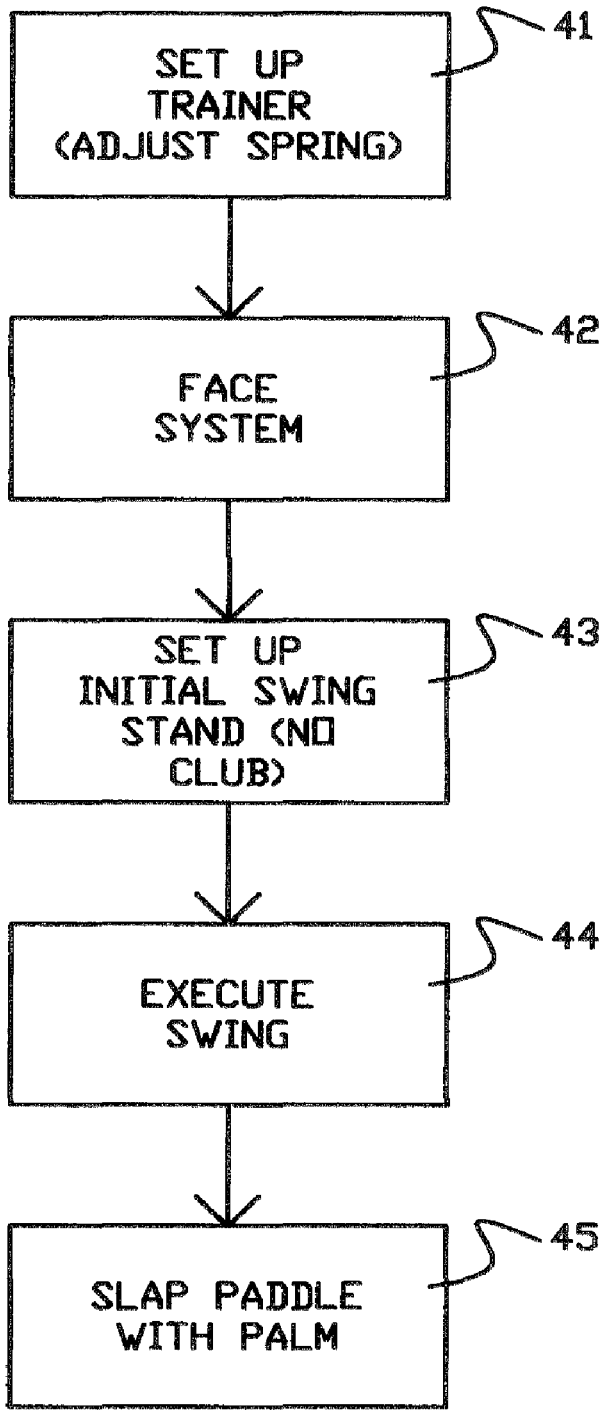
FIG. 7 is a flowchart of one method of using an embodiment of the system.

Accordingly, FIG. 7 shows a method of using a golf swing training system, including step 41 of setting up a golf swing training system with a suitably adjusted spring, step 42 of facing the system, step 43 of setting up an initial golf swing stand as one would for a golf swing, step 44 of executing a golf swing suitable for putting, chipping, or full-golf swing, and step 45 of slapping a palm against a paddle of the system with a suitable force.

A golfer sets up an "initial golf swing stance" as he or she normally does in the beginning of a golf swing according to any method of playing a golf game, except without a club in his or her hand. The step of executing a golf swing and the subsequent step of slapping a palm against a paddle involve a transfer of energy through the swing from one's body to the swing arm and then to the hands. The palm that slaps against the paddle is the palm that normally faces the target during a swing. For a right-handed golfer, the palm is usually the right palm; while for a left-handed golfer, the palm is usually the left palm.

The impact of the palm on the paddle allows a golfer to feel the energy transfer from body to palm. As the palm hits the paddle, the swing arm of the training system will swing forward, and the golfer can get a sense how much force he could transfer from his body to the palm and how efficient is that energy transfer. A golfer can then adjust his stance or swing techniques, maybe subconsciously, to improve the efficiency of this energy transfer through his swing.

The spring tension can be adjusted to strengthen muscles involved in the force transfer. The higher the tension, the more force a golfer's palm will encounter during the impact. The golfer can then add more force to the swing, or find a more optimum positioning and swing to transfer more force from body to palm. Slowly, the golfer will find his or her balance, own swing style, and a suitable swinging force without having to worry about numerous technical points involved in a golf swing. All of the golfer's concentration can be focused on the impact of his or her palm on the paddle. The golfer's own muscle memory circuit can work to optimize the energy transfer from body to palm. In such a way, the muscle memory circuit can actually use the training system to help a golfer improve every point of his or her swing, maybe even unconsciously, and learn to control the force of the swing.

Moreover, with a golf club in his or her hand, a golfer need not worry about having the club get out of its alignment with the target line. In other words, a golfer can focus on feeling the energy transfer from body to palm without being distracted by worrying about numerous technical points in a golf swing.

In this method, one or more soft pads can be removably attached to the side of the paddle where the palm impacts the paddle in a swing. The pads can somewhat protect a golfer's palm from possibly harsh impact with the hard surface of a paddle made of plywood, metal, or other type of wooden material. Hitting one's palm on such a hard surface can cause pain or even injury. With a suitable padding, a golfer can feel the impact of his palm against the paddle without injuring his hand. The soft pads preferably are removable so that the golfer can adjust the amount of padding. By feeling the impact, a golfer can optimize the transfer of energy from body to palm via muscle memory circuits.

Figure 8:
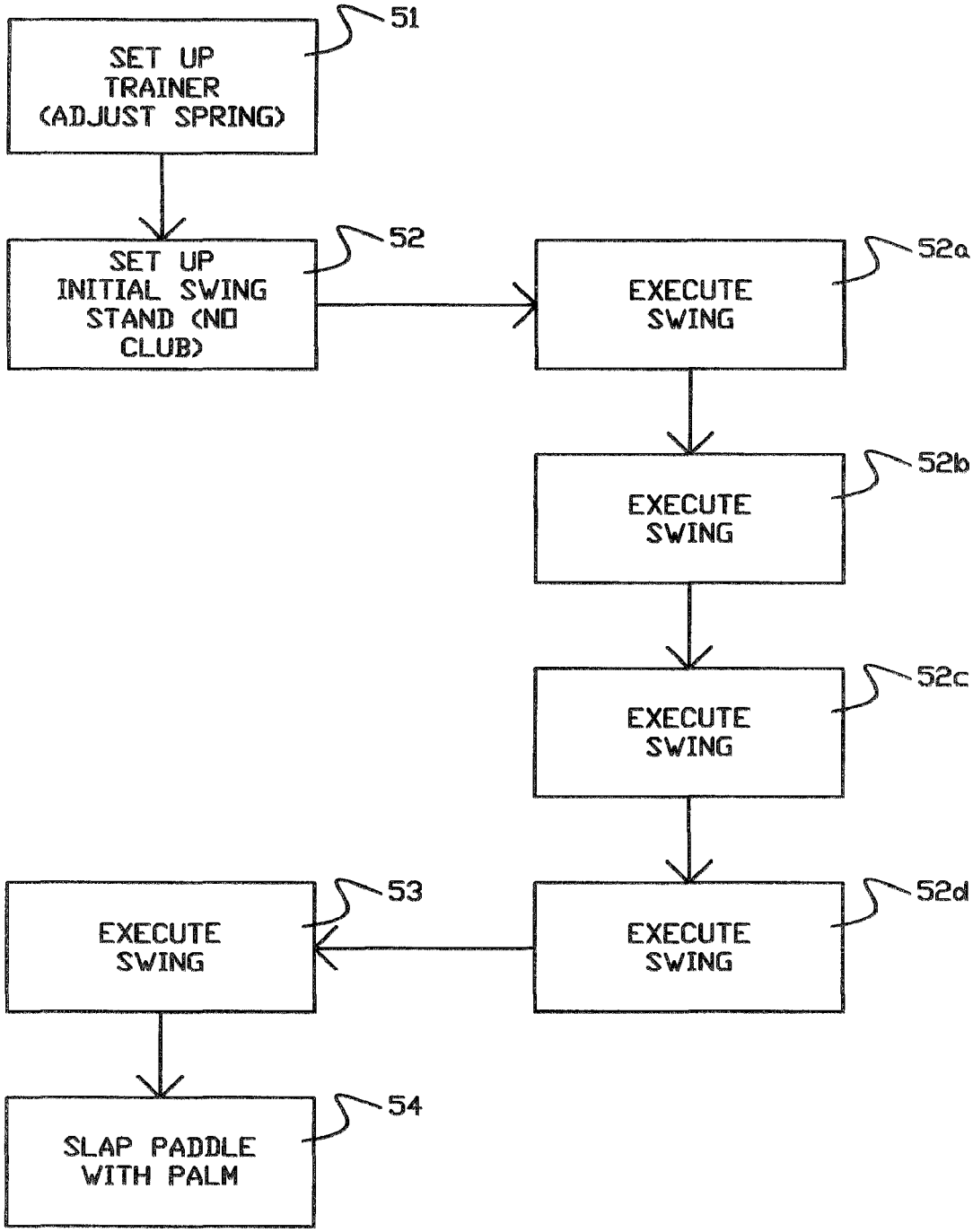
FIG. 8 is a flowchart of one method of using an embodiment of the system.

A further embodiment of a method of using a golf swing training system, as shown in FIG. 8, includes step 51 of setting up a golf swing training system with a suitable force by adjusting a spring; step 52 of setting up an initial golf swing stance by substep 52*a* of facing the golf swing training system, substep 52*b* of visualizing a target line, substep 52*c* of setting up a reference point, substep 52*d* of placing feet parallel to a center line of the system and slightly apart, and substep 52*e* of aligning one's hand next to the paddle and directly under the chin along the target line; step 53 of executing a golf swing suitable for putting, chipping, or full-golf swing using a one-point plane, three-point plan or a five-point plane respectively; and step 54 of slapping a palm against a paddle of the system with a suitable force.

In this method of using golf swing training system, a golfer first finds a target and visualizes a "target line," then sets up a reference point for a five-point plane, three-point plane, or one-point plane. Setting up a reference point in a real golf swing involves aligning the right side of the base of a golfer's neck with the right side of a golf ball. In this case, setting up a reference point with a golf swing training system involves vertically aligning right side of a golfer's neck base with a right side of a swing arm of the system.

Once a reference point is set, a golfer places his feet parallel to the visualized target line alone a centerline of the system and slightly apart. The centerline of the base of this training system represents the beginning portion of the target line. The distance between the balanced feet depends on whether the golfer is going for a full golf swing, a chip, or a putt. For a full golf. Swing, the distance between feet is the widest. For a chipping stance, move the feet closer together than that of a full golf swing. For a putting stance, move the feet a little closer than that of a chipping.

Additionally, in a full golf swing, after setting a reference point and aligning his or her feet, a golfer makes sure his weight is evenly distributed between the toes and the heels of the feet. One way of distribute the body weight evenly is to shift the body weight to the insides of the feet. This tends to keep one's body from swaying when executing a swing. In a chipping swing, a golfer should put the weight on the left foot and the inside of the right foot. This tends to make a golfer's stance more stable with his weight slightly favoring his left side. In a putting swing, a golfer should put his weight mostly on his left foot.

The golfer then strikes the pad with a swing, attempting to achieve the five-point plane, three-point plane, or one-point plane at the time when the golfer's palm strikes the pad. The golfer then should follow through, thereby getting a feel for a proper follow through after impact.

In a further embodiment of a method of using a golf swing training system, the step of executing a golf swing includes a step of executing an upswing and then followed by a step of executing a downswing. The term "upswing," as used herein, refers the process in which a golfer lifts his hands from an initial golf swing stance near the paddle to a pinnacle The term "pinnacle," in this case, refers to the end point of an upswing This pinnacle is different for each golfer depending on the golf swing method that he or she uses, and it is also different for each type of swing: putting, chipping or a full swing. The term "downswing," as used herein, refers a process in which a golfer returns his hands from a pinnacle to hit or slap the paddle with a cumulated force that transferred through the swing from one's body to the swing arm and then to the palm In a further embodiment of a method of using a golf swing training system, when executing an upswing, a golfer keeps his right elbow loosely against his right hip, and then lifts his hands upwards and away from the target line (Note: the target line is between the golf ball and the target, or it is between the trainer swing arm and the visualized target). Next, while lifting his or her hands, a golfer turns his or her left shoulder around the reference point to his or her right side. For a right-handed person, the back of the left hand should face the paddle while the palm of the right hand faces the paddle. This upswing is like winding of a spring, during which a golfer stores up his energy and shifting the energy from the body to the swing arm and then to the palm.

The downswing is almost like unwinding of a spring, in the opposite path of the upswing: A golfer returns his hands back to the paddle, while at the same time, he or she turns the right shoulder around the reference point to the left side. Throughout the swing, the reference point or line should not shift relative to the target line. The downswing will carry a golfer's hands back to the initial stance along the target line, and his right palm (for a right handed person) will slap the paddle of a training system during or at the end of the swing. At the point of the impact, all five points line up to form a five-point plane for a full golf swing. For a chipping, only three points line up to form a three-point plane. For a putting, only one point, the palm of one's right hand, is needed to form a one-point plane at the point of the impact. The golfer can then perform a follow through if so desired.

The impact of the palm on the paddle will signal to a golfer the efficiency of the energy transfer through the swing. A successful golf swing will generate the most effective energy transfer from the body to the palm. The training system provides a way to let a golfer's mind and muscles know just how efficient his or her swing is in transferring energy to the paddle and from the paddle back to his or her hands. One advantage of this technique is that it sets a reference point and a target line for a golfer via the training system's swing arm and a centerline of the system's base. Thus, when a golfer starts using this training system, all he or she needs to do is let his or her own muscles fine-tune his or her swing via the golfer's own muscle memory circuits. In addition, the training system will tend to strengthen muscles needed for successful and consistent golf swings The invention is not limited to the foregoing methods of using a golf swing training system.

Alternative Embodiments

The foregoing discussion was presented generally with respect to a right-handed golfer. The invention is equally applicable to a left-handed golfer, with suitable modification to stance, alignment, etc. to account for the different handedness of a left-handed golfer's swing. Such modification would be apparent to one skilled in the art and would not require undue experimentation or further invention.

Furthermore, the invention is in no way limited to the specifics of any particular embodiments and examples disclosed herein. For example, the terms "preferably," "preferred embodiment," "one embodiment," "this embodiment," "alternative embodiment," "alternatively" and the like denote features that are preferable but not essential to include in embodiments of the invention. The terms "comprising" or "including" mean that other elements and/or steps can be added without departing from the invention. Many other variations are possible which remain within the content, scope and spirit of the invention, and these variations would become clear to those skilled in the art after perusal of this application.

I claim:

1. A golf swing training system, including:

a paddle suitable for hitting with a palm in training to improve one's golf swing;

a swing arm attached to the paddle;

a base that provides stability; and a spring attached to the swing arm and to the base;

wherein the base comprises at least a first part and two second parts arranged in a H shape with the first part corresponding to the cross stroke of the H shape, wherein the first part is in a plane in which the swing arm swings, and wherein the second parts extend further to one side of the first part than another side.

2. A golf swing training system as in claim 1, further including one or more pads attached to a side of the paddle where the palm hits the paddle.

3. A golf swing training system as in claim 1, wherein the swing arm stands vertically when force is not applied to the paddle.

4. A golf swing training system as in claim 1, wherein the swing arm is removably attached to both the paddle and the spring.

5. A golf swing training system as in claim 1, wherein the swing arm is further removably attached to the base.

6. A golf swing training system as in claim 1, wherein the spring is adjustably attached to the swing arm, to the base, or to both the swing arm and to the base.

7. A golf swing training system as in claim 1, wherein the spring is removably attached to the swing arm, to the base, or to both the swing arm and to the base.

8. A golf swing training system as in claim 1, wherein the spring is adjustably and removably attached to the swing arm, to the base, or to both the swing arm and the base.

9. A golf swing training system as in claim 1, wherein the base includes plural detachable parts.

10. A golf swing training system as in claim 9, wherein at least some parts of the base are hollow with one or more caps on their ends, and wherein the caps are removable to permit filler material to be placed in the parts.

11. A golf swing training system as in claim 1, wherein a height and a length of the base are adjustable.

12. A golf swing training system as in claim 1, wherein the base is capable of being attached to a floor or the ground.

13. A golf swing training system as in claim 1, further including a stopper to stop excess motions of the swing arm during golf swing training.

14. A golf swing training system as in claim 13, wherein the stopper partially or completely encircles a junction where the swing arm is attached to the spring, and wherein the stopper is attached to the base.

15. A golf swing training system as in claim 14, wherein the spring and the stopper are removably attached to the base.

16. A golf swing training system as in claim 1, further including a container that is capable of containing all components of the golf swing training system; and a device on or attachable to the container to attach the system to a golf-bag or a golf cart.

* * * * *